United States Patent [19]

Gould

[11] 4,292,951

[45] Oct. 6, 1981

[54] FIREPLACES AND ATTACHMENTS

[76] Inventor: George E. Gould, 13406 Arctic Ave., Rockville, Md. 20853

[21] Appl. No.: 10,805

[22] Filed: Feb. 9, 1979

[51] Int. Cl.[3] ..... F24B 1/18; F23L/11/100

[52] U.S. Cl. ..... 126/120; 126/121; 126/141; 126/285 R; 126/288

[58] Field of Search ..... 126/120, 121, 141, 288, 126/285 R, 164, 165, 131; 236/1 G, 94; 74/39, 520, 521

[56] References Cited

U.S. PATENT DOCUMENTS

| | | | |
|---|---|---|---|
| 1,365,912 | 1/1921 | Greene | 126/121 |
| 1,519,218 | 12/1924 | Richey | 126/120 |
| 2,705,747 | 4/1955 | Strange | 236/94 |
| 3,842,729 | 10/1974 | Mandrup | 74/521 |
| 4,027,655 | 6/1977 | Feldl | 126/288 |

FOREIGN PATENT DOCUMENTS

| | | | |
|---|---|---|---|
| 2822385 | 12/1978 | Fed. Rep. of Germany | 126/132 |
| 7804781 | 11/1978 | Netherlands | 126/288 |
| 734955 | 8/1955 | United Kingdom | 126/141 |

*Primary Examiner*—Samuel Scott
*Assistant Examiner*—Lee E. Barrett
*Attorney, Agent, or Firm*—Raymond N. Baker

[57] ABSTRACT

Fireplace attachments and efficient fireplaces which prevent smoke from escaping from the fireplace into the room. An adjustable controller means is provided which controls the size of an opening to the flue. Also disclosed is a heat deflector means which increases the efficiency of a convection-type heat extractor.

9 Claims, 9 Drawing Figures

FIREPLACES AND ATTACHMENTS

The present invention is related to attachments for improving fireplace operation, and to improved fireplaces. More particularly, the invention is directed to providing an efficient fireplace which keeps smoke from entering the room, and to a heat deflector which improves the efficiency of convection-type fireplace heat extractors.

As is known, in recent years, due to the world-wide energy shortage of many fossil fuels, there has been a strong resurgence of interest in the use of wood and coal burning fireplaces. However, a serious problem associated with the use of such fireplaces is that smoke which is generated by the fire sometimes enters the room in which the fireplace is situated instead of being entirely eliminated up the flue. Once in the room, the smoke is likely to damage whatever it encounters.

This problem represents a major economic loss and is so severe that in recent years damage to property from smoke has been the second largest cause of payouts on homeowner insurance policies. While certain mechanical expedients have been advanced, none has completely solved the problem.

Another problem associated with the fireplace, and one which has precluded more serious use of it as a primary heat source, is its relative inefficiency. As is generally recognized, a very high percentage of the heat which is generated by the fire escapes up the chimney and only a small percentage is projected into the room to be heated, in the form of radiant energy. Much effort has been expended in the prior art towards solving this problem and some improvements have been made.

The present invention is direct towards solving both of the problems discussed above, and provides a fireplace attachment and a fireplace which substantially prevents smoke from escaping into the room, and which, operates at high efficiency.

In accordance with an embodiment of the invention this is accomplished by providing an adjustable controller means which controls the size of an opening to the flue which is located beneath the damper. The controller means comprises a plate which is disposed in the fireplace cavity at an acute angle to the front wall, and which is pivotally mounted for movement of the top of the plate towards and away from the rear wall. When the fire is started the opening is closed down to a smaller aperture, and after a certain temperature has been reached it is opened wider. This arrangement precludes smoke from being pushed out of the fireplace into the room, and further results is highly efficient combustion.

One prior art response to fireplace inefficiency has been the provision of convection-type heat extractor units which operate by pulling room air into the fireplace, heating the air, and expelling it into the room. In accordance with a further aspect of the invention, a heat deflector means for improving the efficiency of such heat extractor units is provided.

The heat deflector means is disposed behind and partially on top of the heat extractor. It intercepts heat from the fire which is moving upwardly and to the rear of the fireplace, and re-directs it to the top of the extractor unit where it is needed, thus significantly increasing the efficiency of the heat extractor. The heat deflector also reflects radiant heat into the room, further inceasing the efficiency of the fireplace.

It is therefore an object of the invention to provide a fireplace attachment and fireplace which prevents smoke from entering the room in which the fireplace is situated.

It is a further object of the invention to provide a fireplace which operates at a high efficiency.

It is still a further object of the invention to provide a fireplace attachment which can be easily and simply installed.

It is still a further object of the invention to provide a device which significantly increases the efficiency of convection-type fireplace heat extractors.

The invention will be better understood by referring to the accompanying drawings in which.

Figure 1:
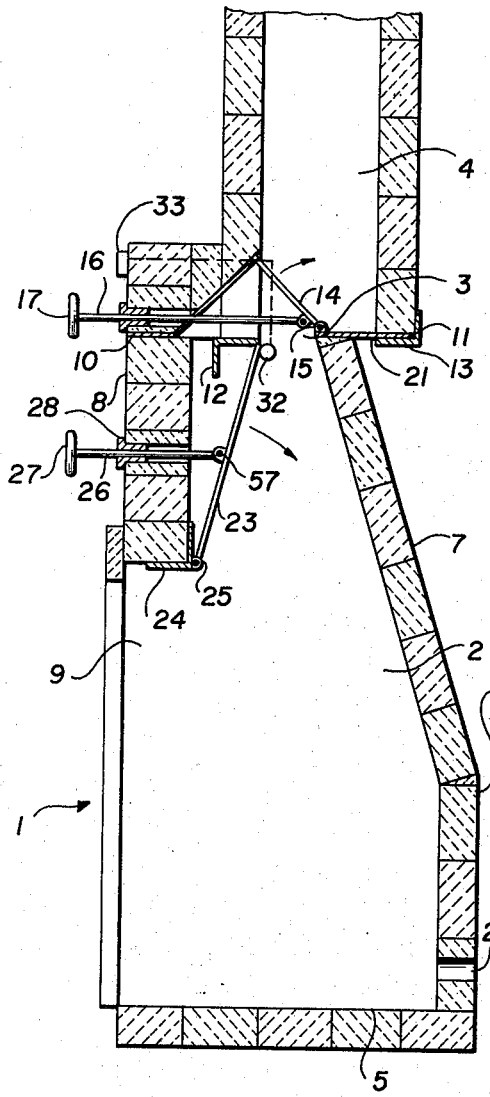
FIG. 1 is a cross-sectional view of a fireplace which incorporates an embodiment of the controller means of the invention.

FIG. 1 shows fireplace 1 which is comprised of cavity 2, throat 3, and flue 4. As is known, when combustibles are burned in cavity 2, smoke ideally flows upward through the throat into the flue and is eliminated from the building through the chimney.

The fireplace cavity 2 is comprised of floor 5, vertically extending lower rear wall portion 6, inwardly sloping upper rear wall portion 7, front wall 8, and front opening 9 which is situated between the bottom of the front wall and the floor, and as shown in the drawing may have glass doors disposed therein.

The fireplace is constructed of bricks or other appropriate masonry. Support plates 10 and 11 are provided at the front and rear portions of the throat respectively, as are lintel plates 12 and 13. Damper 14 is pivotable on a hinge 15 mounted on support plate 11, and is rotable clockwise from the closed position illustrated. The damper is moved by manipulating push rod 16 while grasping handle 17, but it is to be understood that other more elaborate mechanical means may be utilized to move the damper. While the damper is shown as being of the inverted V-type, the invention may be utilized with a fireplace having any type of damper or having no damper at all.

A smoke shelf 21 is provided which sets up a convection current in the flue, with cold air moving down the back wall of the flue and hot air moving up the front wall. While the smoke shelf is of some help in preventing smoke from curling out of the fireplace and into the room, it does not completely solve this problem.

The fireplace 1 has opening 22 in the rear wall which leads to the exterior of the house. Drawing the air directly into the fireplace from the outside results in higher efficiency than drawing the air through door and window cracks, and through the room to the fireplace.

The usual procedure for starting the fire is to open damper 14 all of the way and light combustibles such as wood, or paper if desired, to warm up the flue and establish a draft. After the fire is going, the damper 14 is frequently closed down somewhat to provide a slower burning fire.

During the time when the fire is being started, the fireplace is particularly vulnerable to conditions causing smoke to escape from the fireplace and enter the room. Thus, cold air in the flue, which may be turbulent due to windy conditions outside, is heavier than the hot air from the fire which is rising through the throat. The heavier cold air may thus carry down the hot air and smoke, and the turbulence may push the smoke under the bottom of the front wall, and out into the room through front opening 9. This phenomenon is not limited to the time when the fire is being started, but also may occur during the steady burning period of the fire. Gusts of smoke enter the room suddenly, and smoke damage is done before the fire can be controlled.

In accordance with the invention, controller plate 23 is added to the fireplace to substantially eliminate escaping smoke, and to provide more efficient fireplace operation. Plate 23 is as wide as damper 14, and its lower end is secured to lintel plate 24 by hinge 25. The plate may be made of steel or other rigid metal having appropriate properties, and the upper end of the plate terminates at lintel plate 12 at the front end of the throat for fireplaces of relative dimensions as shown in FIG. 1.

Figure 2:
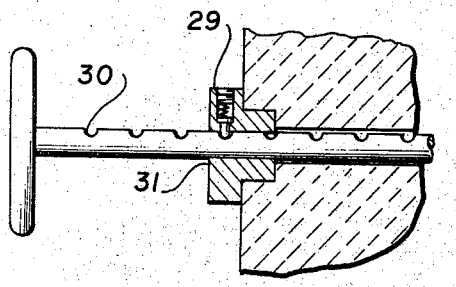
FIG. 2 is a cross-sectional view of a pin and detent variation of push rod 26 of FIG. 1.

Push rod 26 having handle 27 and mounted for movement through sleeve 28 is provided for manually pivoting the controller plate. FIG. 2 shows a variation which utilizes pin 29 which cooperates with detents 30 in the rod to provide adjustable stops. It is to be understood that any type of more complex mechanical means may also be used to move plate 23, and is within the scope of the present invention.

When the controller plate is in the position shown in the FIG. 1, the throat opening is preferably approximately four inches deep. When starting the fire, plate 23 is rotated in the clockwise direction, as is shown in dotted lines in FIG. 3, to close down the opening in the area of the throat to a very small opening, preferably approximately two and a half inches deep. This causes the combination of angularly inclined plate 23 and sloping rear fireplace wall 7 to form a venturi-type opening for the rising smoke. This causes the velocity of the smoke rising through the opening to increase greatly and causes the hot rising air to cut through the cold air in the flue. Additionally, continuous pressure of rising heat from the fire pushes the smoke upwards. Thus, turblence in the heavier cold air cannot push the smoke down into the fireplace and out under the front wall into the room.

After the temperature of the fire increases appreciably, controller plate 23 may be pulled back to the position shown in FIG. 1, which has been found to provide optimum combustion efficiency while also being effective to prevent smoke from escaping. The plate should be pulled back to its FIG. 1 position when the temperature reaches approximately 400° F., and if desired, a temperature sensing device such as a thermocouple 32 may be mounted at the top end of the controller plate. The sensing device is connected to a ammeter of other display means 33 to provide the operator with a temperature indication.

The addition of the controller plate converts the pre-existing fireplace to a Rumford-type fireplace, which provides perfect combustion. The Rumford fireplace has inwardly sloping rear and front walls and has a throat which is approximately 4" deep no matter how large the other dimensions of the fireplace are. Additionally it has a smoke shelf which is 3" to 4" deep, a front wall 13" to 15" long, and is arranged so that a plumb line dropped from the middle of the throat will fall precisely in the middle of the floor or hearth of the fireplace.

Figure 4:
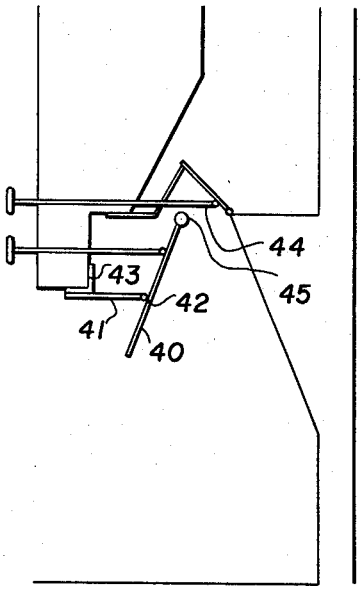
FIGS. 4 and 5 are schematic illustrations of different fireplace structures which incorporate an embodiment of the controller means of the invention.
Figure 5:
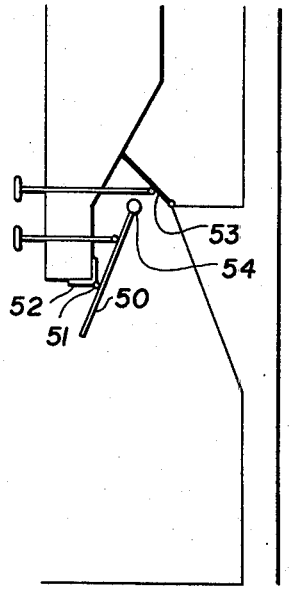

The closer that the fireplace modified by the controller plate can be made into the ideal Rumford type, the better the results obtained will be. Many modern fireplaces are much deeper than specified by Rumford and have shorter front walls, and exemplary modification of such types is depicted in FIGS. 4 and 5. In each case the controller plate is mounted so as to provide a throat having a maximum depth of 4 inches and is extended beneath the short front wall of the fireplace to approximate the long front inwardly sloping wall dictated by Rumford. As in the embodiment of FIG. 1, the controller plate may be rotated in the clockwise direction to provide the smaller opening which is used when starting the fire.

Thus, in FIG. 4 controller plate 40 is pivotally mounted at end 42 of support member 41 which extends into the fireplace from lintel plate 43, to position the plate 40 correctly. In FIG. 5, plate 50 is pivoted at 51 lintel plate 52 to provide proper positioning of the plate for the fireplace shown in the Figure.

Figure 3:
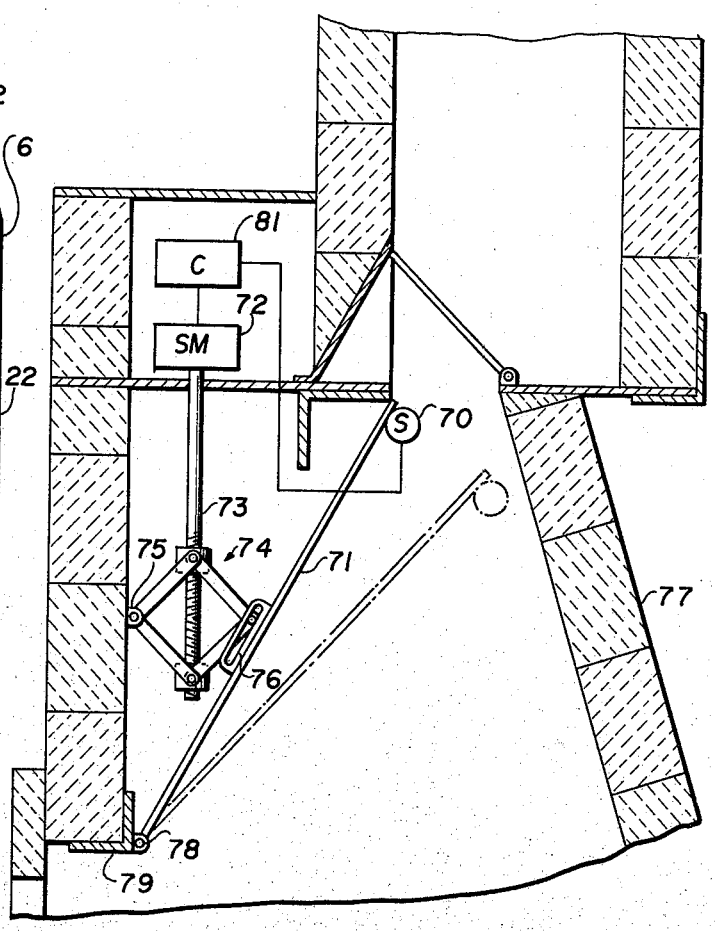
FIG. 3 is a cross-sectional view of a portion of a fireplace incorporating a further embodiment of the controller means of the invention.

In FIG. 3 a further embodiment of the invention in which the controller means is automatically adjustable, is shown. Thermocouple 70 or other temperature sensing means which is mounted at the top end of the controller plate 71 senses the temperature and automatically adjusts the position of the controller plate through the servomechanism means. The output of the sensor 70 is connected to electronic control unit 81, which is arranged to operate servomotor 72 for controlling the displacement of threaded member 73. This member is a part of pantograph mechanism 74 one end of which is secured to the inside of the front wall by bracket 75 and the other end of which is slideably mounted in cam slot 76. As threaded member 73 moves up and down, cam action causes plate 71 to move counterclockwise and clockwise respectively.

Control unit 81 is a well known electronic controller and is set so that the top of controller plate 71 is approximately two and a half inches from the rear wall of the fireplace at starting as explained above. As the fireplace heats up, the thermocouple senses the change in temperature, and the control unit causes the plate to move in the counterclockwise direction. It is to be understood that the servomechanism type of controller shown in FIG. 3 is but one type of automatic control and that other expedients, such as a bimetallic strip which automatically controls displacement as a function of temperature, will occur to those skilled in the art.

While in all of the Figures, the top of the controller plate is at the throat and pivots downwardly into the cavity, it is to be understood that this is the optimum position, and the benefits of the invention can still be obtained if the top of the plate is somewhat above the throat or somewhat below it. Further, while the specific dimensions of the throat depth and controller plate aperture given above are considered to be optimum, other dimensions may also be used and are within the scope of the invention. Also, the controller plate may be utilized in a fireplace not having a damper. When used in such a fireplace it may be desirable to mount the plate for vertical movement to adjust its position in the fireplace opening to optimum.

It can be seen that the controler plate is relatively easy to install in a pre-existing fireplace, as only a few components are necessary. Further, it is simple to operate and should provide long service. If desired, to make access easier for servicing pivot 57 may be attached to a removable inspection plate which is secured to the controller by screws.

Figure 6:
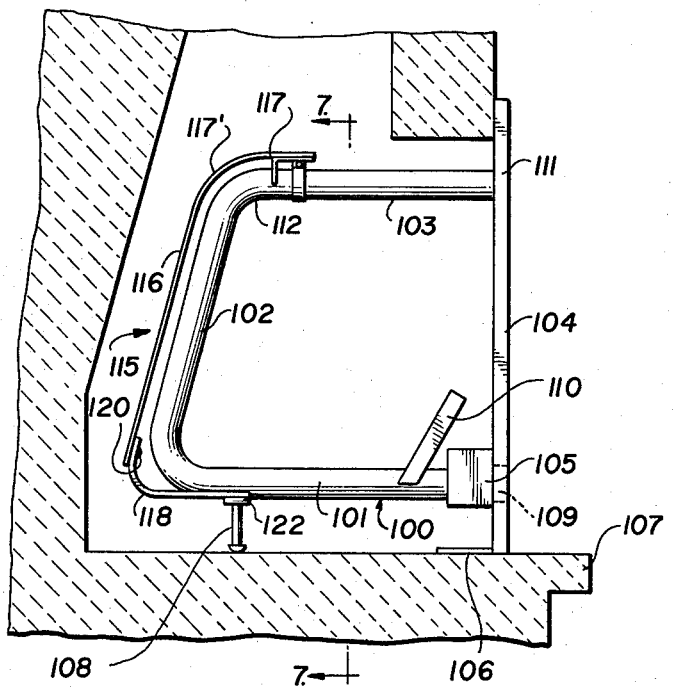
FIG. 6 is a cross-sectional view of a portion of a fireplace which incorporates an embodiment of the heat deflector means of the invention.

An embodiment of the improved heat deflector of the invention is shown in FIG. 6. The purpose of the heat deflector is to make the operation of a convection-type fireplace heat extractor more efficient. Convection-type heat extractors increase the heat output of the fireplace into the room by supplementing the radiant heat of the fireplace with a heated convective airflow output. In general, these devices operate by sucking in room air near the bottom of the fireplace, which is heated in the unit, and upon expansion, rises and is expelled at the front of the fireplace.

Figure 7:
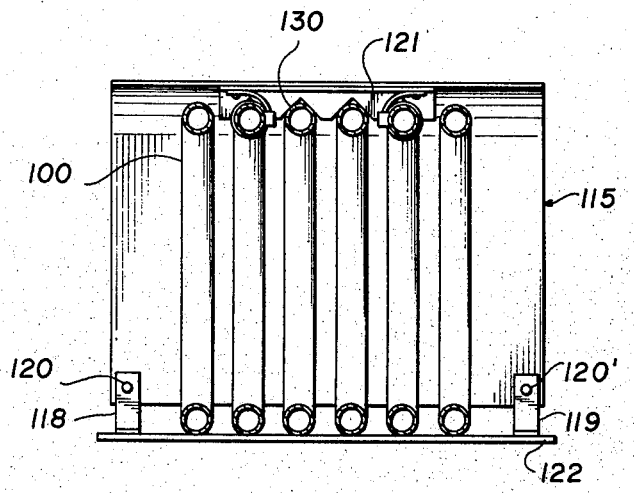
FIG. 7 is a front view further illustrating an embodiment of the heat deflector means of the invention in combination with a heat extractor.

Recently, a type of such a heat extractor using a plurality of C-shaped tubes which are located in the fireplace cavity has become very popular. For instance such a unit is sold under the trademark THERMO-GRATE. A side view of one such C-shaped tube is shown in FIG. 6 and a front view of the unit which is comprised of a plurality of parallel tubes is shown in FIG. 7. Referring to FIG. 6, an entire unit comprised of sliding doors 104, manifold 105, and tubes 100 may be secured in the fireplace by anchors 106 attached to the floor 107 of the fireplace. The C-shaped tubes, which are supported at the rear by support legs 108, are seen to be comprised of bottom portion 101, middle portion 102, and top portion 103.

In the operation of the device, air from the room is taken in at inlet 109. The combustibles are placed on top of the bottom portions of the tubes, behind log retaining bar 110, and ultimately is expelled out of port 11 in the front of the fireplace. In this manner, much of the heat which would have been lost up the chimney is provided to the room.

However, as air inside the tubes rises and turns the upper corner 112 of the tubes, there is an expansion of gases, and the rush of air has tendency to cool the tubes. The heat deflector of the present invention makes the tubes more efficient by intercepting heat from the fire and redirecting it towards the top of the tubes, where it is needed to counteract the cooling effect.

This may be understood by referring to heat deflector 115 in FIGS. 6 and 7, which is seen to be comprised of planar portions 116 and 117 having curved portion 117' therebetween. Since the flue of the fireplace is ordinarily located towards the rear, the fire burns upwardly and rearwardly. Heat deflector 115 which preferably is constructed of a sheet of polished metal such as stainless steel, intercepts the rearwardly directed heat and redirects it towards the tops of the tubes. The rising heat travelling between 116 and 117' is intercepted by the vertical part of angle iron 121 and is transferred into the tubes at 112. Additionally, deflector 115 increases the amount of radiant energy which is outputted to the room by reflecting such energy off of its polished surface, thus increasing the radiating efficiency of the fireplace.

Figure 8:
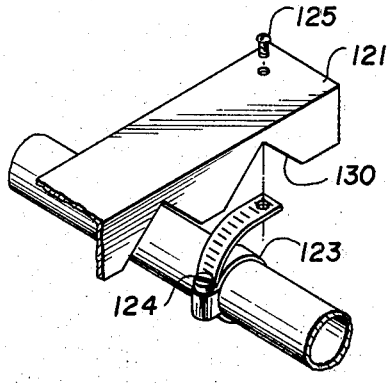
FIG. 8 is an enlarged view in perspective of the attachment for securing the heat deflector means to the heat extractor of FIG. 7.

At the bottom, the deflector plate is secured to cross-member 122 by brackets 118 and 119 which are attached to the deflector by fasteners 120 and 120'. To secure the deflector to the tubes at the top, bracket 121 which includes a plurality of inverted V-shaped cutouts 130 in its front surface, for gripping the tubes, is attached to the plate. The bracket is secured to two or more tubes by clamps 123, as shown in FIG. 8. It should be understood that the above-described arrangement for mounting the deflector plate is illustrative only, and other mechanical mounting expedients will occur to those skilled in the art.

Figure 9:
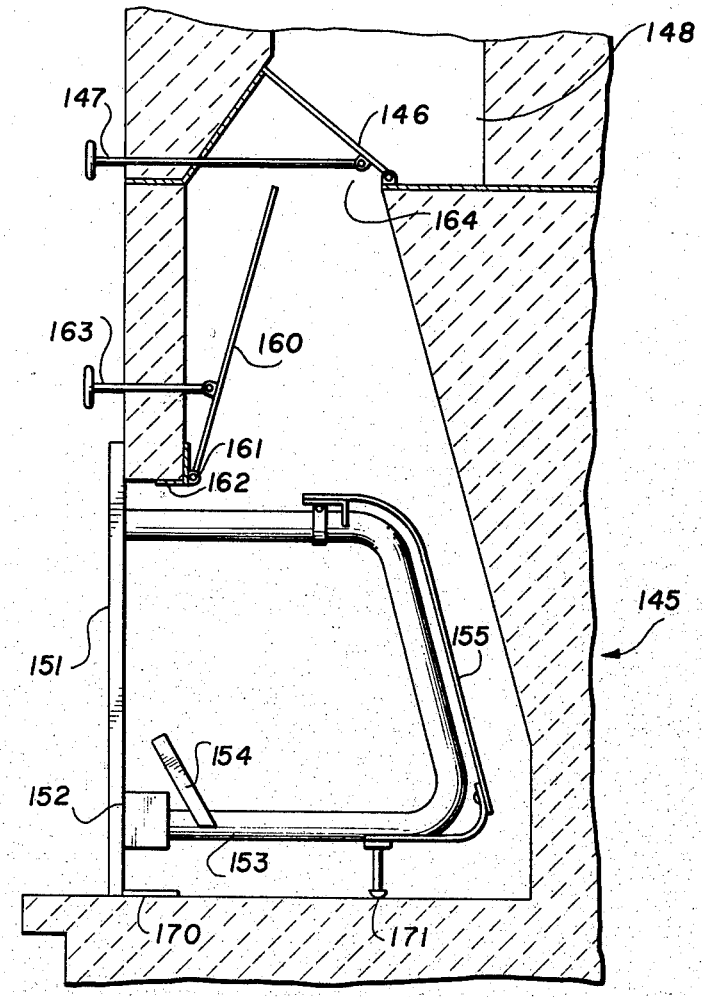
FIG. 9 is a cross-sectional view of a portion of a fireplace which incorporates both an embodiment of the controller means of the invention and an embodiment of the heat deflector means of the invention.

FIG. 9 illustrates a fireplace which incorporates both the controller means and deflector means aspects of the invention. Thus the fireplace shown is highly efficient and will now allow smoke to be pushed out the front of the fireplace.

Heat deflection means 155 is provided behind tubular heat extractor 153 and as discussed above increases the efficiency of the heat extractor, by causing the heat to move straight up insteat of backwards to the wall. Further, controller plate 160 is pivotally attached to lintel plate 162 by hinge 161. The controller plate also operates as discussed above. Hence, smoke rising in the fireplace will move up the flue and will not be forced out into the room by downwardly flowing cold air in the flue.

Thus, fireplace attachments for improving and optimizing fireplaces have been described above. It is to be understood that variations of the attachments themselves and of the resulting fireplaces will occur to those skilled in the art. However, the breadth of the invention is to be construed only in accordance with the claims which are appended hereto.

I claim:

1. A fireplace in a building which substantially prevents smoke from entering the room in which the fireplace is situated, comprising, a fireplace opening comprised of a cavity, a throat, and a flue, the flue being situated above the cavity and leading to the exterior of the building for the elimination of smoke, and the throat being situated at the transition between the cavity and the flue, the cavity including a floor, side walls, a rear wall, and a front wall extending partially to the floor and forming a front opening, movable damper means situated above the throat for selectively changing the size of a first opening to the flue, and adjustable controller means situated below the throat and operable independently of such damper means for controlling the size of a second opening to the flue disposed beneath and in series with the first opening, the adjustable controller means being tiltable about its lower edge and being movable toward the rear wall at its upper portion to form in cooperation with such rear wall a venturi-type opening at said throat, whereby the second opening may be adjusted to ensure that substantially all smoke passes up the flue and not into the room.

2. The fireplace of claim 1 wherein the adjustable controller means comprises a plate of extended surface area which is disposed in the fireplace cavity between the cavity side walls at an acute angle to the front wall and which is pivotally mounted for movement of the upper portion of such plate toward and away from the rear wall.

3. The fireplace of claim 2 wherein the upper portion of such plate terminates at the throat of the fireplace when it is furthest from the rear wall and rotates with such pivotal movement from a location beneath the throat to reduce the size of the second opening when the upper portion of such plate moves closer to the rear wall.

4. The fireplace of claim 3 wherein such controller plate is pivotally secured to the fireplace at the bottom of the front wall.

5. The fireplace of claim 4 wherein such controller plate is substantially as wide as the damper means.

6. The fireplace of claim 2 further including a temperature sensing means located contiguous to the upper portion of such plate, and display means for displaying an indication of the temperature sensed contiguous to such upper portion of the plate.

7. The fireplace of claim 2 further including a temperature sensing means located contiguous to such upper portion of the plate and means responsive to the temperature sensing means for automatically controlling the position of the controller plate responsive to sensed temperature.

8. The fireplace of claim 7 wherein the means for automatically controlling the position of such plate includes servomotor means and pantograph means.

9. A fireplace which substantially prevents smoke from entering a room in a building in which the fireplace is situated, and which operates at a high efficiency, comprising, a fireplace opening comprised of a cavity in which combustibles are to be burned, a throat, and a flue, the flue being situated above the cavity and leading to the exterior of the building for the elimination of smoke resulting from burning of combustibles, the throat being situated at a transition zone between the cavity and the flue, the cavity including a floor, side walls, a rear wall, and a front wall extending partially downwardly toward the floor thus defining a front opening in conjunction with the cavity side walls, movable damper means at the throat for selectively changing the size of a first opening to the flue, a convection-type heat extractor with hollow tubular passages for taking in room air for contiguous to the cavity floor and delivering warmed air into the room thereabove, adjustable control means situated below such damper means in the direction of the cavity and operable independently of such damper means for controlling the size of a second opening to the flue in series with such first opening and located below the first opening in the direction of the cavity, the adjustable controller means being tiltable about its lower edge and being movable toward the rear wall at its upper portion to form in cooperation with such rear wall a venturi-type opening at said throat, whereby the second opening may be adjusted to ensure that substantially all smoke passes up the flue and not into the room, and a heat reflector means for intercepting heat from burning of combustibles located behind and spaced from the heat extractor means between the heat extractor means and the rear wall of the cavity at a position to redirect and reflect such upwardly, rearwardly directed combustion heat toward the heat extractor means.

* * * * *